US011712898B2

(12) United States Patent
Sato et al.

(10) Patent No.: US 11,712,898 B2
(45) Date of Patent: Aug. 1, 2023

(54) LIQUID EJECTING APPARATUS AND WASTE-LIQUID COLLECTING METHOD OF LIQUID EJECTING APPARATUS

(71) Applicant: Seiko Epson Corporation, Tokyo (JP)

(72) Inventors: Hisashi Sato, Shiojiri (JP); Kazushi Arafuka, Matsumoto (JP); Yuichi Urabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/649,834

(22) Filed: Feb. 3, 2022

(65) Prior Publication Data

US 2022/0242128 A1 Aug. 4, 2022

(30) Foreign Application Priority Data

Feb. 4, 2021 (JP) ..... 2021-016330

(51) Int. Cl.
*B41J 2/165* (2006.01)
*B41J 11/00* (2006.01)

(52) U.S. Cl.
CPC ..... *B41J 2/16517* (2013.01); *B41J 11/0021* (2021.01)

(58) Field of Classification Search
CPC ..... B41J 2/16517; B41J 11/0021; B41J 2/16526; B41J 2002/1655; B41J 11/00214; B41J 2/16535
See application file for complete search history.

(56) References Cited

U.S. PATENT DOCUMENTS

2005/0156995 A1* 7/2005 Nishino ..... B41J 2/16538 347/33

FOREIGN PATENT DOCUMENTS

JP 2005-205631 8/2005

* cited by examiner

*Primary Examiner* — Bradley W Thies
(74) *Attorney, Agent, or Firm* — Workman Nydegger

(57) ABSTRACT

A liquid ejecting apparatus includes: a head that ejects a liquid; a curing portion that cures the liquid by emitting energy to the liquid; and a waste-liquid collecting portion that collects the liquid as waste liquid, in which the waste-liquid collecting portion includes an absorber that absorbs the liquid from the head, a first rotational shaft that holds an unused portion of the absorber, and a second rotational shaft that holds a used portion of the absorber, and the curing portion emits the energy to the liquid absorbed by the absorber.

10 Claims, 3 Drawing Sheets

LIQUID EJECTING APPARATUS AND WASTE-LIQUID COLLECTING METHOD OF LIQUID EJECTING APPARATUS

The present application is based on, and claims priority from JP Application Serial Number 2021-016330, filed Feb. 4, 2021, the disclosure of which is hereby incorporated by reference herein in its entirety.

BACKGROUND

1. Technical Field

The present disclosure relates to, for example, a liquid ejecting apparatus and a waste-liquid collecting method of the liquid ejecting apparatus.

2. Related Art

As an example of liquid ejecting apparatuses, an ink jet printer including a head that ejects liquid and an absorber that absorbs the liquid as waste liquid is described in JP-A-2005-205631. In the ink jet printer, the absorber wipes the head to thereby absorb liquid adhering to the head.

In such a liquid ejecting apparatus, for example, the liquid absorbed by the absorber may flow downward from the absorber and soil the inside of the apparatus.

SUMMARY

A liquid ejecting apparatus according to an aspect of the present disclosure includes: a head that ejects a liquid; a curing portion that cures the liquid by emitting energy to the liquid; and a waste-liquid collecting portion that collects the liquid as waste liquid, in which the waste-liquid collecting portion includes an absorber that absorbs the liquid from the head, a first rotational shaft that holds an unused portion of the absorber, and a second rotational shaft that holds a used portion of the absorber, and the curing portion emits the energy to the liquid absorbed by the absorber.

A waste-liquid collecting method of a liquid ejecting apparatus according to an aspect of the present disclosure is a waste-liquid collecting method of a liquid ejecting apparatus that ejects a liquid from a head, the waste-liquid collecting method including: when an absorbed portion of an absorber, which corresponds to a portion that absorbed, as waste liquid, the liquid ejected from the head, is wound by a second rotational shaft, the absorber being held by a first rotational shaft and the second rotational shaft that holds a used portion of the absorber, performing a rewinding operation of rewinding the absorber from the second rotational shaft by using the first rotational shaft that holds an unused portion of the absorber; and curing the liquid by emitting energy to the liquid in the absorbed portion between a portion held by the first rotational shaft and a portion held by the second rotational shaft in parallel with or after the rewinding operation.

A waste-liquid collecting method of a liquid ejecting apparatus according to an aspect of the present disclosure is a waste-liquid collecting method of a liquid ejecting apparatus that ejects a liquid from a head, the waste-liquid collecting method including: when a dimension of an absorbed portion of an absorber, which corresponds to a portion that absorbed, as waste liquid, the liquid ejected from the head, is longer than a dimension of a curing zone that energy for curing the liquid reaches, the absorber being held by a first rotational shaft and a second rotational shaft, emitting the energy to the liquid in the absorbed portion while rewinding the absorber by using the first rotational shaft that holds an unused portion of the absorber.

DESCRIPTION OF EXEMPLARY EMBODIMENTS

An embodiment of a liquid ejecting apparatus will be described below with reference to the drawings. The liquid ejecting apparatus is, for example, an ink jet printer that ejects ink, which is an example of a liquid, onto a medium, such as a sheet or fabric, to thereby record an image, such as a character or a photograph.

Figure 1:
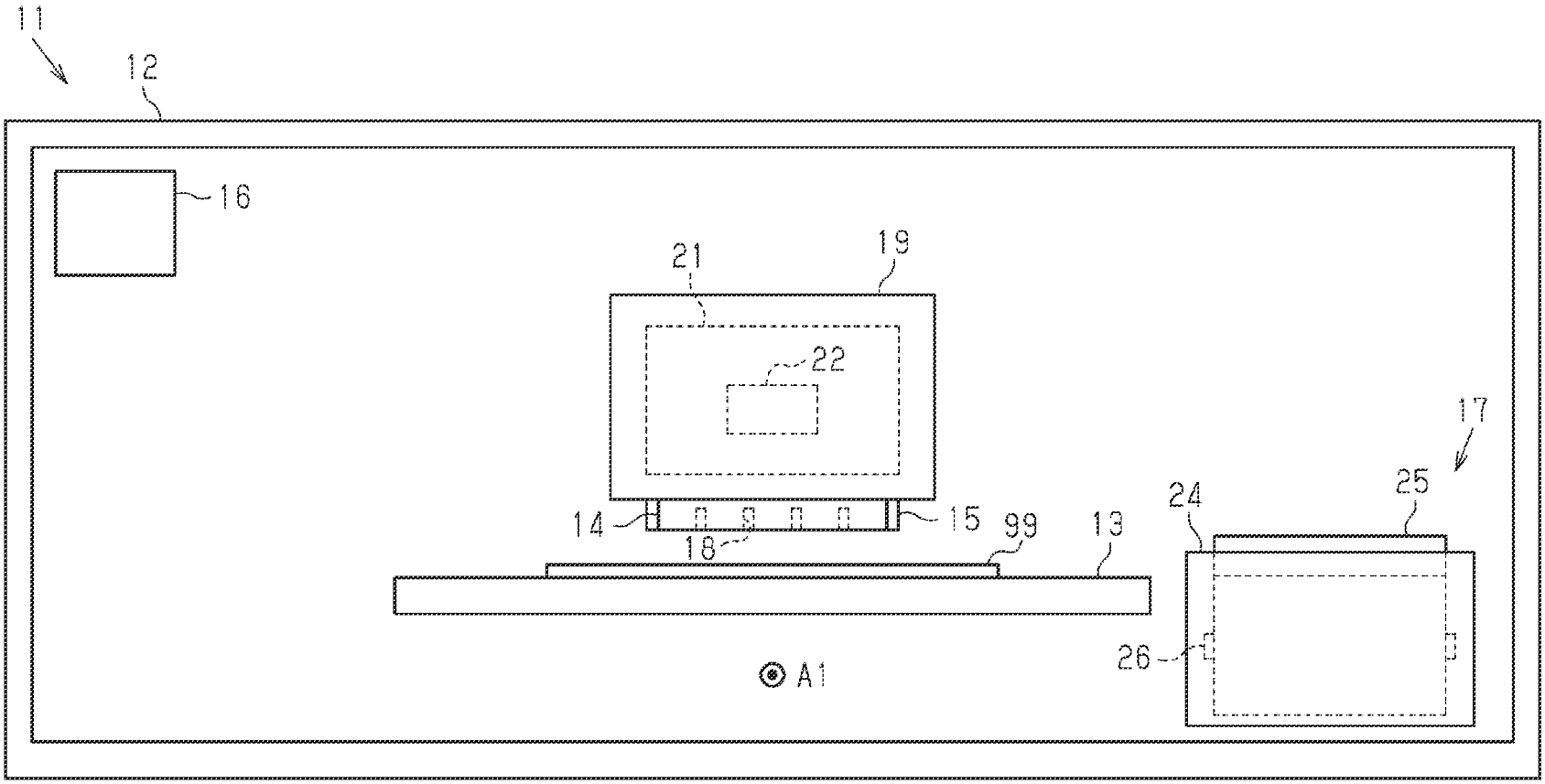
FIG. 1 is a front view illustrating an embodiment of a liquid ejecting apparatus.

As illustrated in FIG. 1, a liquid ejecting apparatus 11 includes a housing 12, a supporting portion 13, a head 14, a curing portion 15, a control portion 16, and a waste-liquid collecting portion 17.

The housing 12 accommodates various components of the liquid ejecting apparatus 11.

The supporting portion 13 is configured to support a medium 99. The supporting portion 13 supports, for example, the medium 99 to be transported.

The head 14 is configured to eject liquid. The head 14 includes one or more nozzles 18 that eject liquid. When liquid is ejected from the nozzles 18 onto the medium 99 supported by the supporting portion 13, an image is recorded on the medium 99.

The liquid ejecting apparatus 11 may include a carriage 19. The head 14 is mounted on the carriage 19. When the carriage 19 performs scanning with respect to the medium 99, the head 14 records an image on the medium 99. In the present embodiment, the carriage 19 is configured to perform scanning with respect to the medium 99 and also move in a direction in which the medium 99 is transported. That is, the liquid ejecting apparatus 11 is a so-called lateral printer. The liquid ejecting apparatus 11 may be a serial printer that performs scanning with respect to the medium 99 or a line printer that is able to eject liquid all at once across the width of the medium 99.

The liquid ejecting apparatus 11 may include a liquid storage portion 21. The liquid storage portion 21 is configured to store liquid. The liquid storage portion 21 is mounted on, for example, the carriage 19. The liquid storage portion 21 is coupled to the head 14. The liquid stored in the liquid storage portion 21 is thus supplied to the head 14.

The liquid ejecting apparatus 11 may include a temperature raising portion 22. The temperature raising portion 22 is configured to raise the temperature of the liquid. The temperature raising portion 22 includes, for example, a heat-generating element. The temperature raising portion 22 generates heat when, for example, a voltage is applied. The temperature raising portion 22 is mounted on, for example, the carriage 19. The temperature raising portion 22 raises, for example, the temperature of the liquid stored in the liquid storage portion 21.

The temperature raising portion 22 raises the temperature of the liquid such that the liquid has appropriate viscosity when the head 14 ejects the liquid. When the temperature of the liquid is low, the viscosity of the liquid is high. In this instance, the head 14 is not able to appropriately eject the liquid. Accordingly, while the temperature raising portion 22 raises the temperature of the liquid, the liquid ejecting apparatus 11 is not able to perform recording. When, for example, power is supplied to the liquid ejecting apparatus 11, the temperature raising portion 22 raises the temperature of the liquid. After raising the temperature of the liquid to an appropriate temperature, the temperature raising portion 22 is driven so as to maintain the temperature of the liquid.

The curing portion 15 is configured to emit energy to the liquid and thereby cure the liquid. The curing portion 15 is configured to emit, for example, light energy, heat energy, electric energy, or the like as the energy. The curing portion 15 emits the energy when, for example, a voltage is applied. In the present embodiment, the curing portion 15 is configured to emit, as an example of light energy, ultraviolet rays to the liquid. The curing portion 15 of the present embodiment thus includes, for example, a light-emitting element. The liquid is cured when irradiated with ultraviolet rays. In the present embodiment, the liquid to be ejected by the head 14 is, for example, UV ink.

The curing portion 15 may emit, for example, infrared rays, radiant heat, or microwaves to the liquid. When the curing portion 15 emits the energy to the liquid in accordance with characteristics of the liquid, curing of the liquid is accelerated.

For example, the curing portion 15 emits the energy to the liquid ejected onto the medium 99 to thereby cure the liquid ejected onto the medium 99. The liquid ejected onto the medium 99 is thereby fixed to the medium 99.

The curing portion 15 is mounted on, for example, the carriage 19. The curing portion 15 is mounted on the carriage 19 so as to be, for example, arranged side by side with the head 14 in a transport direction A1 in which the medium 99 is transported. The curing portion 15 is positioned, for example, upstream of the head 14 in the transport direction A1. When emitting the energy to the liquid ejected onto the medium 99 while the carriage 19 moves, the curing portion 15 fixes the liquid to the medium 99.

The control portion 16 performs overall control of the liquid ejecting apparatus 11, for example. The control portion 16 controls, for example, the head 14, the waste-liquid collecting portion 17, the carriage 19, and the temperature raising portion 22. The control portion 16 can be constituted as a circuit including α: one or more processors that execute various types of processing in accordance with a computer program; β: one or more dedicated hardware circuits, such as an application specific integrated circuit, which execute at least some of the various types of processing; or γ: a combination thereof. A processor includes a CPU and memory such as RAM or ROM, and the memory stores program code or commands which cause the CPU to execute processing. The memory, that is, a computer-readable medium, may be any readable medium accessible by using a general-purpose or dedicated computer.

The waste-liquid collecting portion 17 is configured to collect the liquid from the head 14 as waste liquid. The waste liquid is liquid that does not contribute to recording of an image on the medium 99. The waste liquid is generated when, for example, maintenance of the head 14 is performed. The waste-liquid collecting portion 17 is positioned, for example, next to the supporting portion 13. The waste-liquid collecting portion 17 collects the waste liquid from the head 14 positioned directly above the waste-liquid collecting portion 17.

Examples of maintenance of the head 14 include flushing, cleaning, and wiping.

Flushing is an operation of appropriately ejecting liquid from the nozzle 18 to suppress the nozzle 18 from being clogged. Flushing is performed, for example, before, during, or after recording. When flushing is performed, the head 14 ejects the liquid onto the waste-liquid collecting portion 17.

Cleaning is an operation of intentionally discharging liquid from the nozzle 18 to discharge foreign substances or air bubbles in the head 14. In the present embodiment, pressurizing cleaning in which the head 14 is pressurized such that liquid is intentionally discharged from the nozzle 18 is performed as cleaning. Cleaning is performed, for example, before or after recording. When cleaning is performed, the head 14 discharges the liquid onto the waste-liquid collecting portion 17.

Wiping is an operation of wiping the head 14 to remove the liquid adhering to the head 14. Wiping is performed, for example, after cleaning. When wiping is performed, the head 14 is wiped by the waste-liquid collecting portion 17.

Figure 2:
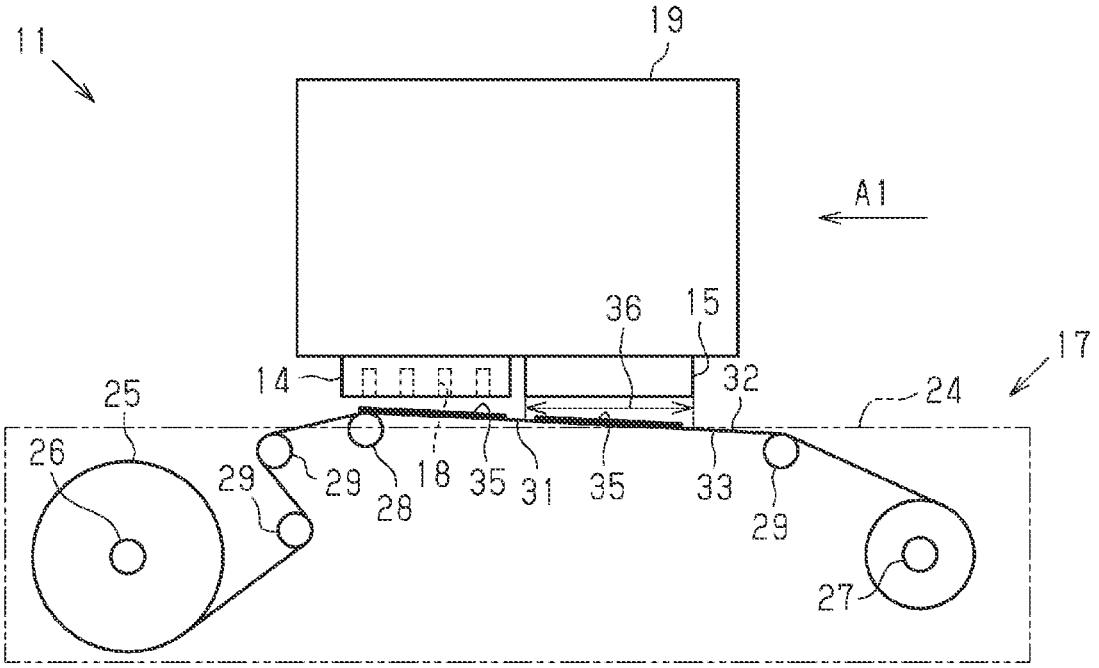
FIG. 2 is a side view of the liquid ejecting apparatus.

As illustrated in FIG. 2, the waste-liquid collecting portion 17 includes a case 24, an absorber 25 that absorbs the liquid, a first rotational shaft 26 that holds the absorber 25, and a second rotational shaft 27 that holds the absorber 25. The waste-liquid collecting portion 17 of the present embodiment includes a pressing roller 28 that presses the absorber 25 against the head 14 and one or more guide rollers 29 that guide the absorber 25.

For example, the absorber 25, the first rotational shaft 26, the second rotational shaft 27, the pressing roller 28, and the guide roller 29 are accommodated in the case 24. The case 24 is configured to be detachably attached to the housing 12, for example. Accordingly, the waste-liquid collecting portion 17 in the liquid ejecting apparatus 11 is replaceable.

The absorber 25 absorbs the liquid from the head 14. The absorber 25 absorbs waste liquid. The absorber 25 may be, for example, fabric or sponge. The absorber 25 is an elongated member.

The absorber 25 is held by the first rotational shaft 26 and the second rotational shaft 27. The absorber 25 includes, for example, a middle portion 31. The middle portion 31 is a portion of the absorber 25 between a portion held by the first rotational shaft 26 and a portion held by the second rotational shaft 27. The middle portion 31 is a portion between a portion wound around the first rotational shaft 26 and a portion wound around the second rotational shaft 27. The absorber 25 receives the liquid which results from, for example, flushing, cleaning, or wiping in a portion of the middle portion 31, which faces the head 14.

The absorber 25 includes a first surface 32 and a second surface 33. The first surface 32 receives liquid from the head 14. Accordingly, the first surface 32 faces the head 14, for example. The second surface 33 is opposite to the first surface 32.

The first rotational shaft 26 holds, for example, an unused portion of the absorber 25. That is, the first rotational shaft 26 holds a portion of the absorber 25, which has not absorbed the liquid. In the present embodiment, the first rotational shaft 26 may temporarily hold a used portion of the absorber 25 but holds mainly an unused portion of the absorber 25. The first rotational shaft 26 thus also functions as a supply portion that supplies an unused portion of the absorber 25.

The first rotational shaft 26 holds the absorber 25 rolled into, for example, a roll shape. In the present embodiment, the first rotational shaft 26 holds the absorber 25 with the first surface 32 facing inward. That is, the first rotational shaft 26 holds the absorber 25 with the second surface 33 facing outward.

The second rotational shaft 27 holds, for example, a used portion of the absorber 25. That is, the second rotational shaft 27 holds a portion of the absorber 25, which has absorbed the liquid. The second rotational shaft 27 thus also functions as a collecting portion that collects a used portion of the absorber 25.

The second rotational shaft 27 holds the absorber 25 rolled into, for example, a roll shape. In the present embodiment, the second rotational shaft 27 holds the absorber 25 with the first surface 32 facing outward. That is, the second rotational shaft 27 holds the absorber 25 with the second surface 33 facing inward.

The first rotational shaft 26 and the second rotational shaft 27 are positioned so as to be arranged in, for example, the transport direction A1. The first rotational shaft 26 and the second rotational shaft 27 are positioned so as to extend in a direction in which the carriage 19 performs scanning.

The first rotational shaft 26 and the second rotational shaft 27 wind or unwind the absorber 25 by rotating. Accordingly, when the first rotational shaft 26 and the second rotational shaft 27 rotate, the absorber 25 is fed downstream or upstream in the transport direction A1. In the present embodiment, the first rotational shaft 26 is positioned downstream of the second rotational shaft 27 in the transport direction A1. The absorber 25 is thus fed mainly upstream in the transport direction A1 in the present embodiment.

The pressing roller 28 is positioned between the first rotational shaft 26 and the second rotational shaft 27 in the transport direction A1. The pressing roller 28 is positioned so as to extend in the direction in which the carriage 19 performs scanning. The pressing roller 28 is held by, for example, the case 24.

The absorber 25 is laid on the pressing roller 28. The middle portion 31 is laid on the pressing roller 28. The pressing roller 28 is in contact with the second surface 33. The pressing roller 28 is configured to move in, for example, the up-down direction. The pressing roller 28 moves to thereby press the middle portion 31 against the head 14. When the head 14 and the waste-liquid collecting portion 17 move relative to each other in a state in which the pressing roller 28 presses the middle portion 31 against the head 14, wiping is performed. Although the head 14 moves relative to the waste-liquid collecting portion 17 in the present embodiment, the waste-liquid collecting portion 17 may move relative to the head 14, or both the head 14 and the waste-liquid collecting portion 17 may move. In the present embodiment, when wiping is performed, the head 14 moves downstream in the transport direction A1 relative to the waste-liquid collecting portion 17 in a state in which the absorber 25 is pressed against the head 14.

The guide roller 29 is positioned between the first rotational shaft 26 and the second rotational shaft 27 in the transport direction A1. The guide roller 29 is positioned so as to extend in the direction in which the carriage 19 performs scanning. The guide roller 29 is held by, for example, the case 24. The guide roller 29 is not necessarily attached to the case 24 and may be attached to, for example, the housing 12.

The absorber 25 is laid on the guide roller 29. The middle portion 31 is laid on the guide roller 29. The guide roller 29 guides, for example, the absorber 25 unwound from the first rotational shaft 26 toward the second rotational shaft 27. The absorber 25 is fed from the first rotational shaft 26 to the second rotational shaft 27 via the pressing roller 28 and the guide roller 29.

Next, collection of the waste liquid by the waste-liquid collecting portion 17 will be described.

When maintenance of the head 14 is performed, the waste-liquid collecting portion 17 collects the waste liquid from the head 14. The waste-liquid collecting portion 17 may collect the waste liquid in a state in which the absorber 25 is stopped or may collect the waste liquid while feeding the absorber 25. When, for example, a large amount of waste liquid is discharged as in cleaning, the waste-liquid collecting portion 17 may collect the waste liquid while feeding the absorber 25.

Figure 3:
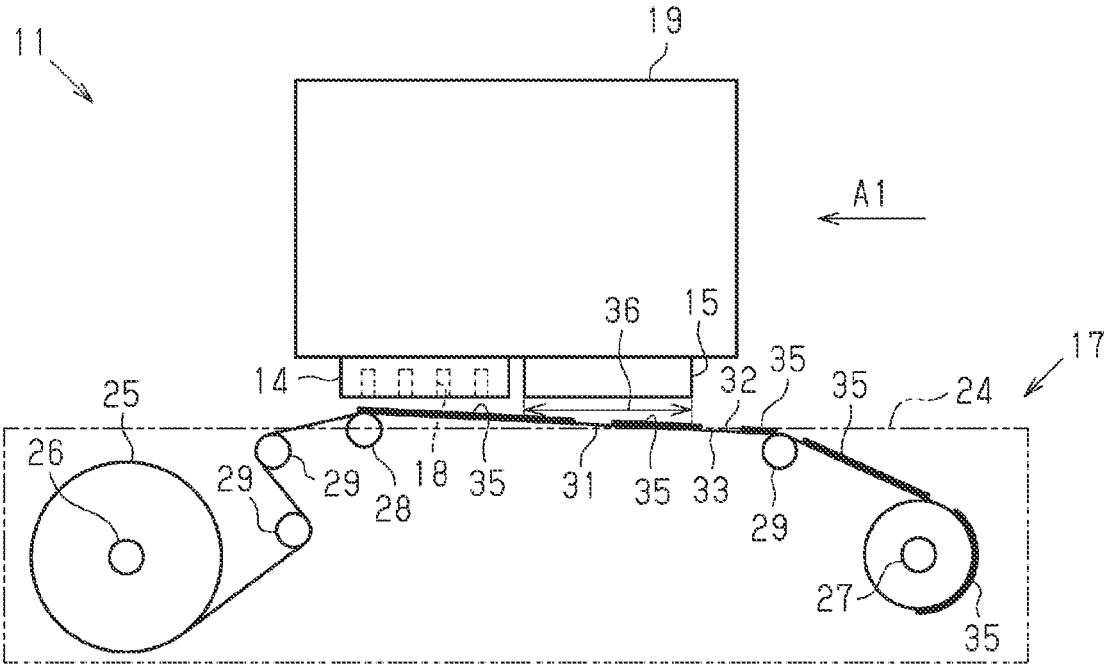
FIG. 3 is a side view illustrating a state in which maintenance of a head has been performed plural times from a state illustrated in FIG. 2.

As illustrated in FIGS. 2 and 3, when the absorber 25 absorbs the liquid, an absorbed portion 35 is formed in the absorber 25. The absorbed portion 35 is a portion of the absorber 25, which has absorbed the liquid. A dimension of the absorbed portion 35 formed in the absorber 25, the number of absorbed portions 35, and the like vary in accordance with a type of maintenance, the number of times maintenance is performed, and the like.

The waste-liquid collecting portion 17 feeds the absorber 25 from the first rotational shaft 26 to the second rotational shaft 27, for example, each time maintenance of the head 14 is performed. When, for example, the maintenance of the head 14 is performed, the waste-liquid collecting portion 17 collects the waste liquid by using an unused portion of the absorber 25. Accordingly, for example, when the amount of the waste liquid collected during a single maintenance is large or when maintenance is performed plural times, the absorbed portion 35 may be wound by the second rotational shaft 27.

When the absorber 25 absorbs the liquid during maintenance of the head 14, the curing portion 15 emits the energy to the liquid absorbed by the absorber 25. The liquid absorbed by the absorber 25 is thereby cured. Curing the liquid absorbed by the absorber 25 reduces possible soiling in the apparatus, which is caused by the liquid flowing downward from the absorber 25 or spattering from the absorber 25.

In the present embodiment, when the curing portion 15 emits the energy to the liquid in the absorbed portion 35, the liquid is cured, and the absorbed portion 35 thus disappears. That is, the absorbed portion 35 is a portion of the absorber 25, which has absorbed the liquid and which is not cured by the curing portion 15.

The liquid ejected from the head 14 may emit a bad odor. When, in particular, the head 14 ejects UV ink, a monomer contained in the UV ink readily emits a bad odor. Accordingly, when the absorber 25 which has absorbed the UV ink is left as is, a bad odor may be emitted from the waste-liquid collecting portion 17. From this viewpoint, since the monomer contained in the UV ink changes into a polymer when the curing portion 15 cures the liquid absorbed by the absorber 25, possible emission of the bad odor from the waste-liquid collecting portion 17 is reduced.

A timing at which the curing portion 15 emits the energy to the liquid absorbed by the absorber 25 is not limited. Although the curing portion 15 emits the energy to the liquid after maintenance of the head 14 is completed in the present embodiment, the curing portion 15 may emit the energy to the liquid in parallel with maintenance of the head 14. The curing portion 15 may emit the energy to the liquid absorbed by the absorber 25, for example, each time maintenance of the head 14 is performed. That is, the liquid may be cured each time the absorber 25 absorbs the liquid. The curing portion 15 may emit the energy to the liquid absorbed by the absorber 25, for example, after maintenance of the head 14 has been performed plural times. The curing portion 15 may emit the energy to the liquid absorbed by the absorber 25, for example, while the temperature raising portion 22 raises the temperature of the liquid. In this instance, since the liquid absorbed by the absorber 25 is cured during a time in which the liquid ejecting apparatus 11 is not able to perform recording, the time in which recording is not able to be performed is effectively utilized.

A time during which the curing portion 15 emits the energy to the liquid absorbed by the absorber 25 may vary in accordance with, for example, the amount of the liquid absorbed by the absorber 25. The time during which the curing portion 15 emits the energy to the liquid absorbed by the absorber 25 may be changed when, for example, a time during which a voltage is applied to the curing portion 15 is changed. The time during which the curing portion 15 emits the energy to the liquid absorbed by the absorber 25 may be changed when the amount by which the absorber 25 is fed by the first rotational shaft 26 and the second rotational shaft 27 per unit time is changed. The time during which the curing portion 15 emits the energy to the liquid absorbed by the absorber 25 is increased when the amount of the liquid absorbed by the absorber 25 is larger. The liquid absorbed by the absorber 25 is thus appropriately cured.

Since the curing portion 15 is mounted on the carriage 19 in the present embodiment, when curing the liquid absorbed by the absorber 25, the curing portion 15 moves to a position directly above the waste-liquid collecting portion 17. The curing portion 15 thereby faces the middle portion 31. Accordingly, in the present embodiment, the curing portion 15 is configured to emit the energy to the middle portion 31 of the absorber 25. After moving to the position directly above the waste-liquid collecting portion 17, the curing portion 15 faces the first surface 32. Accordingly, when curing the liquid absorbed by the absorber 25, the curing portion 15 emits the energy to the first surface 32.

In the present embodiment, when the head 14 faces the middle portion 31, the curing portion 15 is able to face the middle portion 31. Accordingly, the curing portion 15 is able to face the middle portion 31 at a time of maintenance of the head 14. The curing portion 15 is therefore able to cure the liquid absorbed by the absorber 25 in parallel with maintenance of the head 14.

When curing the liquid absorbed by the absorber 25 by using the curing portion 15, the waste-liquid collecting portion 17 causes the absorbed portion 35 to face the curing portion 15 by rotating the first rotational shaft 26 and the second rotational shaft 27. The waste-liquid collecting portion 17 positions the absorbed portion 35, for example, directly below the curing portion 15.

The curing portion 15 emits the energy to a portion of the middle portion 31 which is positioned in a curing zone 36. The curing zone 36 is a zone in which the curing portion 15 is able to emit the energy at a time to the liquid absorbed by the absorber 25. That is, the curing zone 36 is a zone that the energy for curing the liquid reaches. In the present embodiment, the curing zone 36 is a zone in which the curing portion 15 is able to radiate ultraviolet rays at a time. The waste-liquid collecting portion 17 cures the liquid absorbed by the absorber 25 by rotating the first rotational shaft 26 and the second rotational shaft 27 such that the absorbed portion 35 overlaps the curing zone 36.

In the present embodiment, a radiation range of the curing portion 15 includes the entire width of the absorber 25 in a state in which the curing portion 15 faces the middle portion 31. The curing portion 15 is therefore able to emit the energy across the entire width of the absorber 25 at a time.

When the absorbed portion 35 protrudes from the curing zone 36, for example, when a dimension of the absorbed portion 35 is longer than a dimension of the curing zone 36, the waste-liquid collecting portion 17 cures the liquid in the absorbed portion 35 by using the curing portion 15 while feeding the absorber 25. Specifically, the curing portion 15 emits the energy to the liquid in the absorbed portion 35 while the absorber 25 is rewound by the first rotational shaft 26. That is, the curing portion 15 cures the liquid in the absorbed portion 35 in a continuous manner from a portion close to the first rotational shaft 26.

The configuration may be such that "while the absorber 25 is rewound by the first rotational shaft 26" corresponds to an operation of stopping rewinding of the absorber 25 halfway through the rewinding and restarting the rewinding after a predetermined time has elapsed. Accordingly, the configuration in which "the curing portion 15 emits the energy to the liquid in the absorbed portion 35 while the absorber 25 is rewound by the first rotational shaft 26" also includes the configuration in which rewinding of the absorber 25 is stopped halfway through the rewinding and in which the rewinding is restarted after the curing portion 15 emits the energy to the liquid.

At this time, the first rotational shaft 26 may wind the absorber 25 continuously or intermittently. This reduces the possibility of the absorbed portion 35 being wound by the first rotational shaft 26. When, for example, the curing portion 15 cures the liquid in the absorbed portion 35 in a continuous manner from a portion close to the second rotational shaft 27, the absorbed portion 35 may be wound by the first rotational shaft 26. In this instance, the liquid in the absorbed portion 35 may adhere to an unused portion.

Also in an instance in which a plurality of absorbed portions 35 are provided, of the plurality of absorbed portions 35, curing is performed sequentially from an absorbed portion 35 positioned close to the first rotational shaft 26. This reduces the possibility of the absorbed portion 35 being wound by the first rotational shaft 26.

Depending on the amount of the liquid received by the first surface 32, the received liquid may ooze from the second surface 33 in the absorber 25. In the present embodiment, since the curing portion 15 faces the first surface 32, it is difficult to cure the liquid which has oozed from the second surface 33. Accordingly, the absorber 25 may be wound by the first rotational shaft 26 in a state in which the liquid which has oozed from the second surface 33 may be cured insufficiently. From this viewpoint, when winding the absorber 25 after the curing portion 15 emits the energy to the first surface 32, the first rotational shaft 26 winds the absorber 25 with the first surface 32 facing inward. This reduces possible adhesion of the liquid which has oozed from the second surface 33 to an unused portion of the absorber 25.

After the liquid in the absorbed portion 35 is cured by the curing portion 15, the absorber 25 is wound by the second rotational shaft 27. In the present embodiment, as described above, the absorber 25 may be wound by the second rotational shaft 27 in a state in which the liquid which has oozed from the second surface 33 may be cured insufficiently. From this viewpoint, the second rotational shaft 27 winds the absorber 25 with the second surface 33 facing inward after the curing portion 15 emits the energy to the first surface 32. This reduces the possibility that the liquid which has oozed from the second surface 33 flows downward from the second surface 33. Moreover, possible emission of a bad odor from the liquid which has oozed from the second surface 33 is reduced.

In the present embodiment, as described above, the absorber 25 may be wound by the second rotational shaft 27 before the curing portion 15 emits the energy to the liquid in the absorbed portion 35. When the second rotational shaft 27 winds the absorbed portion 35, the liquid in the absorbed portion 35 adheres to a used portion of the absorber 25 held by the second rotational shaft 27. The amount of the liquid in the absorbed portion 35 is thereby reduced, and the liquid in the absorbed portion 35 is readily cured. In particular, the liquid on the side of the second surface 33 is readily cured. Accordingly, the waste-liquid collecting portion 17 may cure the liquid in the absorbed portion 35 by using the curing portion 15 after causing the second rotational shaft 27 to wind the absorbed portion 35 temporarily and then causing the absorbed portion 35 to be rewound from the second rotational shaft 27 to the first rotational shaft 26. In this manner, when causing the second rotational shaft 27 to wind the absorbed portion 35 before the curing portion 15 emits the energy to the liquid in the absorbed portion 35, the waste-liquid collecting portion 17 may cause the absorber 25 to be rewound from the second rotational shaft 27 to the first rotational shaft 26 and cure the liquid in the rewound absorbed portion 35. In this instance, the curing portion 15 may emit the energy to a used portion of the absorber 25 to which the liquid which has oozed from the second surface 33 adheres.

Next, a specific example of a waste-liquid collecting method performed by the control portion 16 controlling the waste-liquid collecting portion 17 will be described. The waste-liquid collecting portion 17 performs, for example, an absorbing operation of absorbing the waste liquid. The waste-liquid collecting portion 17 performs a curing operation of curing the collected waste liquid, for example, after the absorbing operation is completed. The curing operation may be performed after the absorbing operation is performed plural times. A timing at which the curing operation is performed is not limited. For example, the curing operation may be performed in accordance with an instruction from a user or when the temperature raising portion 22 raises the temperature of the liquid. The control portion 16 controls the waste-liquid collecting portion 17 to perform the absorbing operation and the curing operation. The waste liquid is collected through the absorbing operation and the curing operation.

Although the waste-liquid collecting portion 17 collects the waste liquid and then cures the waste liquid in the present embodiment, the waste-liquid collecting portion 17 may cure the waste liquid while collecting the waste liquid. When the waste liquid is cured while being collected, the absorber 25 absorbs the liquid from the head 14 and receives the energy emitted from the curing portion 15 while being fed from the first rotational shaft 26 to the second rotational shaft 27.

When maintenance of the head 14 is performed, the control portion 16 performs the absorbing operation. The control portion 16 causes the absorber 25 to absorb the waste liquid in the absorbing operation. At this time, the control portion 16 controls the first rotational shaft 26 and the second rotational shaft 27 to cause an unused portion of the absorber 25 to face the head 14.

The control portion 16 causes the unused portion of the absorber 25 to absorb the waste liquid. For example, when wiping is performed, the control portion 16 brings the absorber 25 into contact with the head 14. For example, when flushing or cleaning is performed, the control portion 16 causes the absorber 25 to receive the liquid ejected from the head 14. The absorbed portion 35 is thereby formed in the absorber 25. The control portion 16 ends the absorbing operation after absorbing the waste liquid by using the absorber 25.

Figure 4:
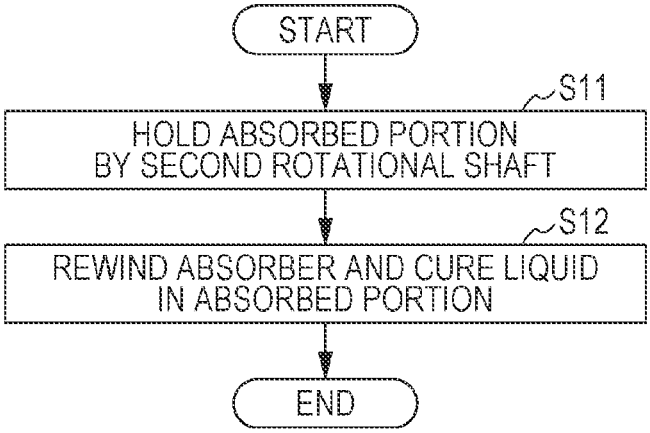
FIG. 4 is a flowchart of an example of a curing operation.

As illustrated in FIG. 4, the control portion 16 causes the second rotational shaft 27 to hold the absorbed portion 35 in step S11. That is, the control portion 16 causes the second rotational shaft 27 to wind the absorbed portion 35. At this time, the control portion 16 controls the first rotational shaft 26 and the second rotational shaft 27 to feed the absorber 25 from the first rotational shaft 26 to the second rotational shaft 27. When the absorbed portion 35 is held by the second rotational shaft 27, the liquid in the absorbed portion 35 adheres to a used portion. When a plurality of absorbed portions 35 are provided, control is performed such that all the absorbed portions 35 are held by the second rotational shaft 27, for example. Accordingly, the control portion 16 causes the second rotational shaft 27 to wind the absorbed portion 35 before the curing portion 15 emits the energy to the liquid in the absorbed portion 35.

The control portion 16 rewinds the absorber 25 and cures the liquid in the absorbed portion 35 in step S12. At this time, the control portion 16 controls the first rotational shaft 26 and the second rotational shaft 27 to perform a rewinding operation of rewinding the absorber 25 from the second rotational shaft 27 to the first rotational shaft 26. The control portion 16 performs the rewinding operation to thereby position the absorbed portion 35 in the curing zone 36. When a plurality of absorbed portions 35 are provided, of the plurality of absorbed portions 35, the control portion 16 positions an absorbed portion 35 closest to the first rotational shaft 26 in the curing zone 36. The control portion 16 controls the curing portion 15 to thereby cure the liquid in the absorbed portion 35. The control portion 16 controls the curing portion 15, the first rotational shaft 26, and the second rotational shaft 27 to thereby cure the liquid absorbed by the absorber 25 in a continuous manner from a portion close to the first rotational shaft 26. Here, the rewinding operation corresponds to operation from when the rewinding is started to when the rewinding is completed.

In step S12, the control portion 16 may cure the liquid while rewinding the absorber 25 or after completing the rewinding. For example, when the absorbed portion 35 protrudes from the curing zone 36 or when a plurality of absorbed portions 35 are provided, the control portion 16 cures the liquid while rewinding the absorber 25. When a single absorbed portion 35 is provided and when the absorbed portion 35 is within the curing zone 36, the control portion 16 cures the liquid after completing the rewinding. That is, the curing portion 15 emits the energy to the liquid in the absorbed portion 35 in parallel with or after the rewinding operation of rewinding the absorber 25 from the second rotational shaft 27 to the first rotational shaft 26. The configuration may be such that, as the rewinding operation, the rewinding of the absorber 25 is stopped during the rewinding operation and restarted after a predetermined time has elapsed. Accordingly, the configuration in which the curing portion 15 emits the energy to the liquid in the absorbed portion 35 in parallel with the rewinding operation also includes a configuration in which the rewinding of the absorber 25 is stopped during the rewinding operation and restarted after the curing portion 15 emits the energy.

In the rewinding operation, the control portion 16 may rewind the absorber 25 by the dimension longer than the dimension of the absorber 25 fed from the first rotational shaft 26 to the second rotational shaft 27 when the second rotational shaft 27 winds the absorbed portion 35 in step S11. The control portion 16 may rewind the absorber 25 such that, for example, a used portion to which the liquid in the absorbed portion 35 is expected to adhere when the absorbed portion 35 is wound by the second rotational shaft 27 is positioned in the curing zone 36. In this instance, the control portion 16 causes the curing portion 15 to emit the energy to the liquid in the absorbed portion 35 in parallel with the rewinding operation.

When completing the processing in step S12, the control portion 16 ends the curing processing. As a result, the liquid absorbed by the absorber 25 is cured.

Next, operation and effects of the aforementioned embodiment will be described.

(1) The curing portion 15 emits energy to liquid absorbed by the absorber 25.

According to the aforementioned configuration, the liquid absorbed by the absorber 25 is cured by the curing portion 15. For example, possible soiling inside the apparatus, which is caused by the liquid flowing downward from the absorber 25, is thereby able to be reduced. Moreover, possible emission of a bad odor from the liquid absorbed by the absorber 25 is able to be reduced.

(2) The second rotational shaft 27 winds the absorber 25 with the second surface 33 facing inward after the curing portion 15 emits the energy to the first surface 32.

When the absorber 25 receives the liquid on the first surface 32 from the head 14, the absorbed liquid may ooze from the second surface 33. Since the curing portion 15 emits the energy to the first surface 32, it is difficult to cure the liquid which has oozed from the second surface 33. Accordingly, when, for example, the second rotational shaft 27 winds the absorber 25 with the second surface 33 facing outward, the liquid which has oozed from the second surface 33 may flow downward from the second surface 33. From this viewpoint, according to the aforementioned configuration, since the second rotational shaft 27 winds the absorber 25 with the second surface 33 facing inward, the possibility that the liquid which has oozed from the second surface 33 flows downward from the second surface 33 is reduced. Moreover, possible emission of a bad odor from the liquid which has oozed from the second surface 33 is able to be reduced.

(3) When winding the absorber 25 after the curing portion 15 emits the energy to the first surface 32, the first rotational shaft 26 winds the absorber 25 with the first surface 32 facing inward.

When the absorber 25 receives the liquid on the first surface 32 from the head 14, the absorbed liquid may ooze from the second surface 33. Since the curing portion 15 emits the energy to the first surface 32, it is difficult to cure the liquid which has oozed from the second surface 33. Accordingly, when, for example, the first rotational shaft 26 winds the absorber 25 with the second surface 33 facing inward, the liquid which has oozed from the second surface 33 may adhere to an unused portion of the absorber 25. From this viewpoint, according to the aforementioned configuration, since the first rotational shaft 26 winds the absorber 25 with the first surface 32 facing inward, possible adhesion of the liquid which has oozed from the second surface 33 to an unused portion of the absorber 25 is reduced.

(4) When the second rotational shaft 27 winds the absorbed portion 35 before the curing portion 15 emits the energy to the liquid in the absorbed portion 35, the waste-liquid collecting portion 17 performs the rewinding operation of rewinding the absorber 25 from the second rotational shaft 27 to the first rotational shaft 26. The curing portion 15 emits the energy to the liquid in the absorbed portion 35 in parallel with or after the rewinding operation.

According to the aforementioned configuration, when the second rotational shaft 27 winds the absorbed portion 35, the liquid which has oozed from the second surface 33 is absorbed in a used portion. In this instance, since the amount of the liquid in the absorbed portion 35 is reduced, the liquid in the absorbed portion 35 is readily cured.

(5) In the rewinding operation, the absorber 25 is rewound by the dimension longer than the dimension of the absorber 25 fed from the first rotational shaft 26 to the second rotational shaft 27 when the second rotational shaft 27 winds the absorbed portion 35. The curing portion 15 emits the energy to the liquid in the absorbed portion 35 in parallel with the rewinding operation.

According to the aforementioned configuration, it is possible to cure the liquid adhering to a used portion of the absorber 25 due to the absorbed portion 35 being wound by the second rotational shaft 27. Further, possible emission of a bad odor from the liquid adhering to the used portion of the absorber 25 is able to be reduced.

(6) When a dimension of the absorbed portion 35 corresponding to a portion of the absorber 25, which has absorbed the liquid, is longer than a dimension of the curing zone 36 in which the curing portion 15 is able to emit the energy at a time, the curing portion 15 emits the energy to the liquid absorbed by the absorber 25 while the first rotational shaft 26 rewinds the absorber 25.

According to the aforementioned configuration, the curing portion 15 is able to cure the liquid absorbed by the absorber 25 from a portion close to the first rotational shaft 26. This reduces the possibility of the absorbed portion 35 being wound by the first rotational shaft 26. As a result, possible adhesion of the liquid in the absorbed portion 35 to an unused portion of the absorber 25 is reduced.

(7) A time during which the curing portion 15 emits the energy to the liquid absorbed by the absorber 25 is changed in accordance with the amount of the liquid absorbed by the absorber 25.

According to the aforementioned configuration, it is possible to effectively cure the liquid absorbed by the absorber 25.

(8) The curing portion 15 emits the energy to the liquid absorbed by the absorber 25 while the temperature raising portion 22 raises the temperature of the liquid.

According to the aforementioned configuration, it is possible to effectively utilize a time during which the temperature raising portion 22 raises the temperature of the liquid.

The present embodiment is able to be modified and implemented in the following manner. The present embodiment and the following modified examples may be implemented in combination within a range in which they do not technically conflict with each other.

The first rotational shaft 26 and the second rotational shaft 27 may be positioned so as to be arranged in the direction in which the carriage 19 performs scanning. In an instance of a line printer, the first rotational shaft 26 and the second rotational shaft 27 may be positioned so as to be arranged in the longitudinal direction of the head 14. In such a modified example, the first rotational shaft 26 and the second rotational shaft 27 are positioned so as to extend, for example, in the transport direction A1.

A curing portion that cures the liquid absorbed by the absorber 25 may be provided separately in addition to the curing portion 15 that cures the liquid ejected onto the medium 99.

The curing portion 15 may be configured to emit the energy to a portion held by the second rotational shaft 27. For example, the curing portion 15 may be configured to emit the energy to a portion of the absorber 25, which is held by the second rotational shaft 27.

The curing portion 15 may be configured to emit the energy to the second surface 33 of the absorber 25. For example, the curing portion 15 may be positioned so as to face the second surface 33.

The curing portion 15 may be provided so as to be arranged side by side with the head 14 in the direction in which the carriage 19 performs scanning.

The curing portion 15 is not necessarily able to emit the energy across the entire width of the first surface 32 at a time, and, for example, the radiation range of the curing portion 15 does not necessarily include the entire width of the absorber 25. In such an instance, when the curing portion 15 or the absorber 25 moves, the curing portion 15 is able to emit the energy across the entire width of the absorber 25.

The first rotational shaft 26 may unwind an unused portion of the absorber 25 toward the side of the second rotational shaft 27 when maintenance is completed. At this time, the absorber 25 may be wound by the second rotational shaft 27 by an amount of the absorber 25 unwound from the first rotational shaft 26. Accordingly, when no maintenance is performed, the unused portion of the absorber 25 is positioned between the first rotational shaft 26 and the second rotational shaft 27, thus reducing the possibility of a user touching the absorbed portion 35 or a portion in which the liquid absorbed by the absorber 25 has been cured.

When being cured, the liquid absorbed by the absorber 25 may form unevenness on the surface of the absorber 25. In an instance in which a portion in which the liquid has been cured is at a position facing the head 14 or the curing portion 15, when the carriage 19 is moved, the head 14 or the curing portion 15 and the portion in which the liquid has been cured may scratch each other.

Also in this instance, when an unused portion of the absorber 25 is positioned between the first rotational shaft 26 and the second rotational shaft 27, it is possible to reduce scratching of the head 14 or the curing portion 15 and the portion in which the liquid has been cured. At this time, it is sufficient that a dimension of an unused portion of the absorber 25 which is unwound by the first rotational shaft 26 be equivalent to a dimension of the head 14 or the curing portion 15. That is, it is sufficient that the head 14 or the curing portion 15 face an unused portion of the absorber 25.

In an instance in which an unused portion of the absorber 25 is positioned between the first rotational shaft 26 and the second rotational shaft 27 when maintenance is completed, maintenance is restarted desirably after the first rotational shaft 26 performs an operation of winding the unused portion of the absorber 25. According to this configuration, the absorber 25 is able to be used from the portion following the portion previously used for the maintenance, thus making it possible to reduce a use amount of the absorber 25.

The liquid to be ejected by the head 14 is not limited to ink and may be, for example, a liquid-state material in which particles of a functional material are dispersed or mixed in a liquid. For example, the head 14 may eject a liquid-state material that contains, in a dispersed or dissolved form, a material, such as an electrode material or a pixel material, which is used for, for example, manufacturing a liquid crystal display, an electroluminescent display, or a surface emitting display.

Technical ideas and operational effects obtained from the above-described embodiment and modified examples will be described below.

(A) A liquid ejecting apparatus includes: a head that ejects a liquid; a curing portion that cures the liquid by emitting energy to the liquid; and a waste-liquid collecting portion that collects the liquid as waste liquid, in which the waste-liquid collecting portion includes an absorber that absorbs the liquid from the head, a first rotational shaft that holds an unused portion of the absorber, and a second rotational shaft that holds a used portion of the absorber, and the curing portion emits the energy to the liquid absorbed by the absorber.

According to the aforementioned configuration, the liquid absorbed by the absorber is cured by the curing portion. This reduces, for example, the possibility of the liquid flowing downward from the absorber, thus making it possible to reduce possible soiling inside the apparatus.

(B) In the liquid ejecting apparatus, the absorber may include a first surface for receiving the liquid from the head and a second surface opposite to the first surface, the curing portion may be configured to emit the energy to the first surface, and the second rotational shaft may wind the absorber with the second surface facing inward after the energy is emitted to the first surface by the curing portion.

When the absorber receives the liquid on the first surface from the head, the absorbed liquid may ooze from the second surface. Since the curing portion emits the energy to the first surface, it is difficult to cure the liquid which has oozed from the second surface. Accordingly, when, for example, the second rotational shaft 27 winds the absorber with the second surface facing outward, the liquid which has oozed from the second surface may flow downward from the second surface. From this viewpoint, according to the aforementioned configuration, since the second rotational shaft winds the absorber with the second surface facing inward, the possibility that the liquid which has oozed from the second surface flows downward from the second surface is reduced.

(C) In the liquid ejecting apparatus, the absorber may include a first surface for receiving the liquid from the head and a second surface opposite to the first surface, the curing portion may be configured to emit the energy to the first surface, and when winding the absorber after the energy is emitted to the first surface by the curing portion, the first rotational shaft may wind the absorber with the first surface facing inward.

When the absorber receives the liquid on the first surface from the head, the absorbed liquid may ooze from the second surface. Since the curing portion emits the energy to the first surface, the liquid which has oozed from the second surface is difficult to be cured. Accordingly, when, for example, the first rotational shaft winds the absorber with the second surface facing inward, the liquid which has oozed from the second surface may adhere to an unused portion of the absorber. From this viewpoint, according to the aforementioned configuration, since the first rotational shaft winds the absorber with the first surface facing inward, possible adhesion of the liquid, which has oozed from the second surface, to an unused portion of the absorber is reduced.

(D) In the liquid ejecting apparatus, the curing portion may be configured to emit the energy to a portion of the absorber between a portion held by the first rotational shaft and a portion held by the second rotational shaft, when the second rotational shaft winds an absorbed portion corresponding to a portion of the absorber, which absorbed the liquid, before the curing portion emits the energy to the liquid in the absorbed portion, the waste-liquid collecting portion may perform a rewinding operation of rewinding the absorber from the second rotational shaft to the first rotational shaft, and the curing portion may emit the energy to the liquid in the absorbed portion in parallel with or after the rewinding operation.

According to the aforementioned configuration, when the second rotational shaft winds the absorbed portion, the liquid which has oozed from the second surface is absorbed in a used portion. In this instance, since the amount of the liquid in the absorbed portion is reduced, the liquid in the absorbed portion is readily cured.

(E) In the liquid ejecting apparatus, in the rewinding operation, the absorber may be rewound by a dimension longer than a dimension of the absorber fed from the first rotational shaft to the second rotational shaft when the second rotational shaft winds the absorbed portion, and the curing portion may emit the energy to the liquid in the absorbed portion in parallel with the rewinding operation.

According to the aforementioned configuration, it is possible to cure the liquid adhering to a used portion of the absorber due to the absorbed portion being wound by the second rotational shaft.

(F) In the liquid ejecting apparatus, when a dimension of the absorbed portion corresponding to a portion of the absorber, which has absorbed the liquid, is longer than a dimension of the curing zone in which the curing portion is able to emit the energy at a time, the curing portion may emit the energy to the liquid absorbed by the absorber while the first rotational shaft rewinds the absorber.

According to the aforementioned configuration, the curing portion is able to cure the liquid absorbed by the absorber from a portion close to the first rotational shaft. This reduces the possibility of the absorbed portion being wound by the first rotational shaft. As a result, possible adhesion of the liquid in the absorbed portion to an unused portion of the absorber is reduced.

(G) In the liquid ejecting apparatus, a time during which the curing portion emits the energy to the liquid absorbed by the absorber may be changed in accordance with an amount of the liquid absorbed by the absorber.

According to the aforementioned configuration, it is possible to effectively cure the liquid absorbed by the absorber.

(H) The liquid ejecting apparatus may further include a temperature raising portion configured to raise the temperature of the liquid to be ejected by the head, in which the curing portion may emit the energy to the liquid absorbed by the absorber while the temperature raising portion raises the temperature of the liquid.

According to the aforementioned configuration, it is possible to effectively utilize a time during which the temperature raising portion raises the temperature of the liquid.

(I) A waste-liquid collecting method of a liquid ejecting apparatus that ejects a liquid from a head includes: when an absorbed portion of an absorber, which corresponds to a portion that absorbed, as waste liquid, the liquid ejected from the head, is wound by a second rotational shaft, the absorber being held by a first rotational shaft and the second rotational shaft that holds a used portion of the absorber, performing a rewinding operation of rewinding the absorber from the second rotational shaft by using the first rotational shaft that holds an unused portion of the absorber; and curing the liquid by emitting energy to the liquid in the absorbed portion between a portion held by the first rotational shaft and a portion held by the second rotational shaft in parallel with or after the rewinding operation.

According to the aforementioned configuration, it is possible to obtain an effect similar to that of the above-described liquid ejecting apparatus.

(J) A waste-liquid collecting method of a liquid ejecting apparatus that ejects a liquid from a head includes: when a dimension of an absorbed portion of an absorber, which corresponds to a portion that absorbed, as waste liquid, the liquid ejected from the head, is longer than a dimension of a curing zone that energy for curing the liquid reaches, the absorber being held by a first rotational shaft and a second rotational shaft, emitting the energy to the liquid in the absorbed portion while rewinding the absorber by using the first rotational shaft that holds an unused portion of the absorber.

According to the aforementioned configuration, it is possible to obtain an effect similar to that of the above-described liquid ejecting apparatus.

What is claimed is:

1. A liquid ejecting apparatus comprising:
- a head configured to eject a liquid;
- a curing portion that cures the liquid by emitting energy to the liquid; and
- a waste-liquid collecting portion configured to collect the liquid as waste liquid, wherein
- the waste-liquid collecting portion includes
  - an absorber configured to absorb the liquid discharged from the head,
  - a first rotational shaft configured to hold the absorber before absorption of the liquid, and
  - a second rotational shaft configured to hold the absorber after absorption of the liquid, and
- the curing portion emits the energy to the liquid absorbed by the absorber.

2. The liquid ejecting apparatus according to claim 1, wherein
- the absorber includes a first surface for receiving the liquid from the head and a second surface opposite to the first surface,
- the curing portion is configured to emit the energy to the first surface, and
- the second rotational shaft winds the absorber so that the second surface faces inward after the energy is emitted to the first surface by the curing portion.

3. The liquid ejecting apparatus according to claim 1, wherein
- the absorber includes a first surface for receiving the liquid from the head and a second surface opposite to the first surface,
- the curing portion is configured to emit the energy to the first surface, and
- the first rotational shaft is configured to wind the absorber after absorption of the liquid and, when winding the absorber after the energy is emitted to the first surface by the curing portion, the first rotational shaft winds the absorber so that the first surface faces inward.

4. The liquid ejecting apparatus according to claim 2, wherein
- the curing portion is configured to emit the energy to a portion of the absorber between a portion held by the first rotational shaft and a portion held by the second rotational shaft,
- when the second rotational shaft winds an absorbed portion corresponding to a portion of the absorber, which absorbed the liquid, before the curing portion emits the energy to the liquid in the absorbed portion, the waste-liquid collecting portion performs a rewinding operation of rewinding the absorber from the second rotational shaft to a side of the first rotational shaft, and the curing portion emits the energy to the liquid in the absorbed portion in parallel with or after the rewinding operation.

5. The liquid ejecting apparatus according to claim 4, wherein in the rewinding operation, the absorber is rewound by a dimension longer than a dimension of the absorber fed from the first rotational shaft to the second rotational shaft when the second rotational shaft winds the absorbed portion, and the curing portion emits the energy to the liquid in the absorbed portion in parallel with the rewinding operation.

6. The liquid ejecting apparatus according to claim 1, wherein in a case in which a portion of the absorber, which absorbed the liquid, is an absorbed portion, when a dimension of the absorbed portion before the curing portion performs curing is longer than a dimension of a curing zone in which the curing portion is configured to emit the energy at a time, the curing portion emits the energy to the liquid absorbed by the absorber while the first rotational shaft rewinds the absorber.

7. The liquid ejecting apparatus according to claim 1, wherein a time during which the curing portion emits the energy to the liquid absorbed by the absorber is changed in accordance with an amount of the liquid absorbed by the absorber.

8. The liquid ejecting apparatus according to claim 1, further comprising a temperature raising portion configured to raise a temperature of the liquid to be ejected by the head, wherein the curing portion emits the energy to the liquid absorbed by the absorber while the temperature raising portion raises the temperature of the liquid.

9. A waste-liquid collecting method of a liquid ejecting apparatus that ejects a liquid from a head, the waste-liquid collecting method comprising:

in an absorber held by a first rotational shaft and a second rotational shaft, when the second rotational shaft that holds a used portion of the absorber wound an absorbed portion, which is a portion that absorbed the liquid ejected from the head, performing a rewinding operation of rewinding the absorber from the second rotational shaft by using the first rotational shaft that holds an unused portion of the absorber; and curing the liquid by emitting energy to the liquid in the absorbed portion between a portion held by the first rotational shaft and a portion held by the second rotational shaft in parallel with or after the rewinding operation.

10. A waste-liquid collecting method of a liquid ejecting apparatus that ejects a liquid from a head, the waste-liquid collecting method comprising:

in an absorber held by a first rotational shaft and a second rotational shaft, when a dimension of an absorbed portion of an absorber, which corresponds to a portion that absorbed the liquid ejected from the head, is longer than a dimension of a curing zone that energy for curing the liquid reaches, the absorber being held by a first rotational shaft and a second rotational shaft, emitting the energy to the liquid in the absorbed portion while rewinding the absorber by using the first rotational shaft that holds an unused portion of the absorber.

* * * * *